US007736203B2

(12) United States Patent
Copper et al.

(10) Patent No.: US 7,736,203 B2
(45) Date of Patent: Jun. 15, 2010

(54) WEDGE CONNECTOR ASSEMBLY

(75) Inventors: Charles Dudley Copper, Hummelstown, PA (US); Steven Mitchell, Thompsons Station, TN (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/897,553

(22) Filed: Aug. 29, 2007

(65) Prior Publication Data

US 2009/0061698 A1 Mar. 5, 2009

(51) Int. Cl.
*H01R 4/52* (2006.01)

(52) U.S. Cl. ..... 439/836; 439/787; 439/783; 439/863

(58) Field of Classification Search ..... 439/863, 439/836, 783, 787
See application file for complete search history.

(56) References Cited

U.S. PATENT DOCUMENTS

| | | | | |
|---|---|---|---|---|
| 3,235,944 | A | | 2/1966 | Broske |
| 3,329,928 | A | | 7/1967 | Broske |
| 3,588,791 | A | | 6/1971 | Polidori |
| 3,811,105 | A | | 5/1974 | Gerhard |
| 4,027,939 | A | | 6/1977 | White |
| 4,247,159 | A | | 1/1981 | Fruchard |
| 4,279,461 | A | | 7/1981 | Bussen et al. |
| 4,471,159 | A | | 9/1984 | Frank, Jr. |
| 4,600,264 | A | | 7/1986 | Counsel |
| 4,684,196 | A | | 8/1987 | Smith et al. |
| 4,723,921 | A | | 2/1988 | Pooley |
| 4,764,131 | A | | 8/1988 | Beinhaur |
| 4,863,403 | A | | 9/1989 | Shannon |
| 4,915,653 | A | | 4/1990 | Mair |
| 5,006,081 | A | * | 4/1991 | Counsel et al. ..... 439/783 |
| 5,044,996 | A | * | 9/1991 | Goto ..... 439/783 |
| 5,145,420 | A | * | 9/1992 | Counsel et al. ..... 439/783 |
| 5,244,422 | A | * | 9/1993 | Laricchia ..... 439/783 |
| 5,342,224 | A | | 8/1994 | Lefavour |

(Continued)

FOREIGN PATENT DOCUMENTS

WO WO 98/27621 A 6/1998

OTHER PUBLICATIONS

J.D. Sprecher et al., Wedge-Connector Technology in Power Utility Applications, AMP Journal of Technology, vol. 5, Jun. 1996, pp. 4-13.

*Primary Examiner*—Tho D Ta
*Assistant Examiner*—Travis Chambers

(57) ABSTRACT

A wedge connector assembly includes a spring member having a generally C-shaped body with an inner surface, and a wedge member having opposed first and second sides. The wedge member is mated with the spring member such that the wedge member is configured to securely retain a first conductor between the first side and the spring member and a second conductor between the second side and the spring member. The wedge member has at least two final mating positions based on the orientation of the wedge member with respect to the spring member. Optionally, the wedge member may have two orientations, namely a first orientation and a second orientation, wherein the first and second sides are flipped with respect to one another in the first and second orientations. A top of the wedge member may engage the inner surface in the first orientation and a bottom of the wedge member may engage the inner surface in the second orientation.

26 Claims, 7 Drawing Sheets

U.S. PATENT DOCUMENTS 5,692,930 A 12/1997 Garver et al.
5,704,816 A 1/1998 Polidori
5,752,860 A 5/1998 Greaves
5,774,987 A 7/1998 Chadbourne et al.
5,830,019 A * 11/1998 Chadbourne et al. ..... 439/783
5,862,589 A 1/1999 Chadbourne et al.
6,004,165 A 12/1999 Dinh et al.
6,086,406 A 7/2000 Francois et al.
6,120,334 A 9/2000 Timsit et al.
6,517,391 B1 2/2003 Chadbourne
6,595,472 B1 7/2003 Pisczak

* cited by examiner

WEDGE CONNECTOR ASSEMBLY

BACKGROUND OF THE INVENTION

This invention relates generally to electrical connectors, and more particularly, to power utility connectors for mechanically and electrically connecting a tap or distribution conductor to a main electrical transmission conductor.

Electrical utility firms constructing, operating and maintaining overhead and/or underground power distribution networks and systems utilize connectors to tap main power transmission conductors and feed electrical power to distribution line conductors, sometimes referred to as tap conductors. The main power line conductors and the tap conductors are typically high voltage cables that are relatively large in diameter, and the main power line conductor may be differently sized from the tap conductor, requiring specially designed connector components to adequately connect tap conductors to main power line conductors. Generally speaking, three types of connectors are commonly used for such purposes, namely bolt-on connectors, compression-type connectors, and wedge connectors.

Bolt-on connectors typically employ die-cast metal connector pieces or connector halves formed as mirror images of one another, sometimes referred to as clam shell connectors. Each of the connector halves defines opposing channels that axially receive the main power conductor and the tap conductor, respectively, and the connector halves are bolted to one another to clamp the metal connector pieces to the conductors. Such bolt-on connectors have been widely accepted in the industry primarily due to their ease of installation, but such connectors are not without disadvantages. For example, proper installation of such connectors is often dependent upon predetermined torque requirements of the bolt connection to achieve adequate connectivity of the main and tap conductors. Applied torque in tightening the bolted connection generates tensile force in the bolt that, in turn, creates normal force on the conductors between the connector halves. Applicable torque requirements, however, may or may not be actually achieved in the field and even if the bolt is properly tightened to the proper torque requirements initially, over time, and because of relative movement of the conductors relative to the connector pieces or compressible deformation of the cables and/or the connector pieces over time, the effective clamping force may be considerably reduced. Additionally, the force produced in the bolt is dependent upon frictional forces in the threads of the bolt, which may vary considerably and lead to inconsistent application of force among different connectors.

Compression connectors, instead of utilizing separate connector pieces, may include a single metal piece connector that is bent or deformed around the main power conductor and the tap conductor to clamp them to one another. Such compression connectors are generally available at a lower cost than bolt-on connectors, but are more difficult to install. Hand tools are often utilized to bend the connector around the cables, and because the quality of the connection is dependent upon the relative strength and skill of the installer, widely varying quality of connections may result. Poorly installed or improperly installed compression connectors can present reliability issues in power distribution systems.

Wedge connectors are also known that include a C-shaped channel member that hooks over the main power conductor and the tap conductor, and a wedge member having channels in its opposing sides. The wedge member is driven through the C-shaped member, deflecting the ends of the C-shaped member and clamping the conductors between the channels in the wedge member and the ends of the C-shaped member. An application tool is used to drive the wedge member to a proper position with respect to the channel member to achieve a repeatable, consistent connection with the conductors. One such wedge connector is commercially available from Tyco Electronics Corporation of Harrisburg, Pa. and is known as an AMPACT Tap or Stirrup Connector. AMPACT connectors include different sized channel members to accommodate a set range of conductor sizes, and multiple wedge sizes for each channel member. Each wedge accommodates a different conductor size. As a result, AMPACT connectors tend to be more expensive than either bolt-on or compression connectors due to the increased part count. For example, a user may be required to possess three channel members that accommodate a full range of conductor sizes. Additionally, each channel member may require up to five wedge members to accommodate each conductor size for the corresponding channel member. As such, the user must carry fifteen connector pieces in the field to accommodate the full range of conductor sizes. The increased part count increases the overall expense and complexity of the AMPACT connectors.

AMPACT connectors are believed to provide superior performance over bolt-on and compression connectors. For example, the AMPACT connector results in a wiping contact surface that, unlike bolt-on and compression connectors, is stable, repeatable, and consistently applied to the conductors, and the quality of the mechanical and electrical connection is not as dependent on torque requirements and/or relative skill of the installer. Additionally, and unlike bolt-on or compression connectors, because of the deflection of the ends of the C-shaped member some elastic range is present wherein the ends of the C-shaped member may spring back and compensate for relative compressible deformation or movement of the conductors with respect to the wedge and/or the C-shaped member.

It would be desirable to provide a lower cost, more universally applicable alternative to conventional wedge connectors that provides superior connection performance to bolt-on and compression connectors.

BRIEF DESCRIPTION OF THE INVENTION

In one aspect, a wedge connector assembly is provided including a spring member having a generally C-shaped body with an inner surface, and a wedge member having opposed first and second sides. The wedge member is mated with the spring member such that the wedge member is configured to securely retain a first conductor between the first side and the spring member and a second conductor between the second side and the spring member. The wedge member has at least two final mating positions.

Optionally, the wedge member may have two orientations, namely a first orientation and a second orientation, wherein the first and second sides are flipped with respect to one another in the first and second orientations. A top of the wedge member may engage the inner surface in the first orientation and a bottom of the wedge member may engage the inner surface in the second orientation. Optionally, the wedge member may include a leading end and a notch extending inward from the leading end. The notch may also extend inward from one of top and the bottom. Optionally, the spring member may include a channel, wherein the wedge member is initially loaded into the channel during mating, and wherein the initial loading orientation of the wedge member with respect to the spring member is reversible. The wedge member may be configured to be loaded to the at least two final mating positions using the same application tool.

In another aspect, a wedge connector assembly is provided including a spring member having a generally C-shaped body having an inner surface, and a wedge member having a top, a bottom and opposed sides tapered between a leading end and a trailing end. The wedge member has a notch extending from the leading end along the bottom, wherein the notch has an open face at the leading end and a base wall generally opposed to the open face. The wedge member is configured to be mated to a first mated depth when the notch is in a first orientation with respect to the spring member and the wedge member is configured to be mated to a second mated depth when the notch is in a second orientation with respect to the spring member.

In a further aspect, a wedge connector assembly is provided including a spring member having a generally C-shaped body having an inner surface and an outer surface. The assembly also includes a wedge member having a top, a bottom and opposed sides tapered between a leading end and a trailing end. One of the spring member and the wedge member has an opening, and the other of the spring member and the wedge member has a barb extending from a surface thereof. The barb is received within a respective opening to define a mating position when the wedge member is mated with the spring member. The wedge member has at least two final mating positions.

DETAILED DESCRIPTION OF THE INVENTION

Figure 1:
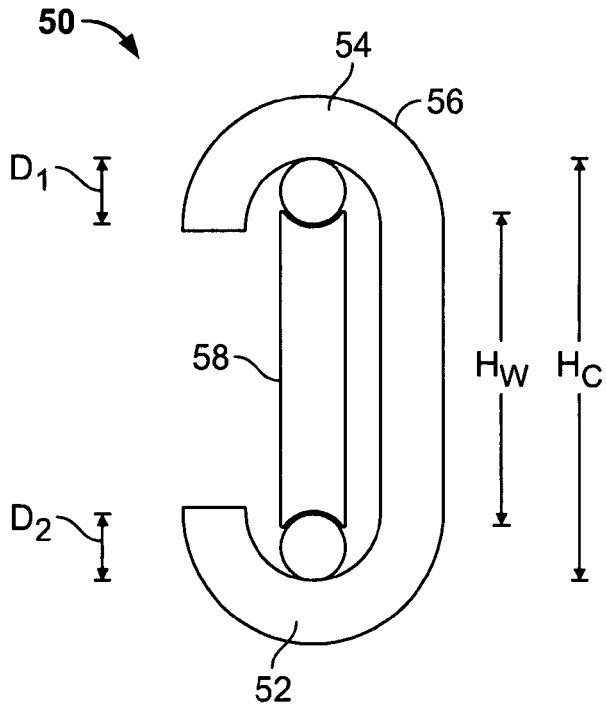
FIG. 1 (Prior Art)
FIG. 1 is a side elevational view of a known wedge connector assembly.
Figure 2:
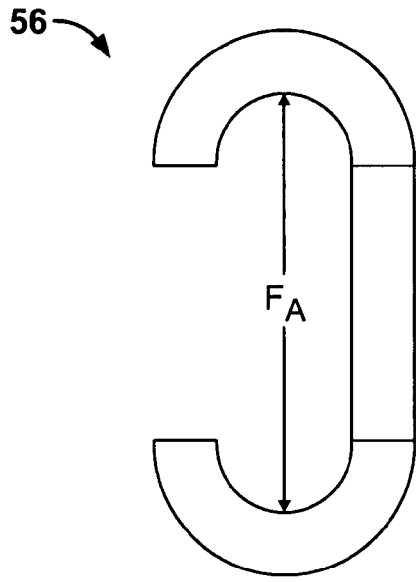
FIG. 2 (Prior Art)
FIG. 2 is a side elevational view of a portion of the assembly shown in FIG. 1.

FIGS. 1 and 2 illustrate a known wedge connector assembly 50 for power utility applications wherein mechanical and electrical connections between a tap or distribution conductor 52 and a main power conductor 54 are to be established. The connector assembly 50 includes a C-shaped spring member 56 and a wedge member 58. The spring member 56 hooks over the main power conductor 54 and the tap conductor 52, and the wedge member 58 is driven through the spring member 56 to clamp the conductors 52, 54 between the ends of the wedge member 58 and the ends of the spring member 56.

The wedge member 58 may be installed with special tooling having for example, gunpowder packed cartridges, and as the wedge member 58 is forced into the spring member 56, the ends of the spring member 56 are deflected outwardly and away from one another via the applied force $F_A$ shown in FIG. 2. Typically, the wedge member 58 is fully driven to a final position wherein the front end of the wedge member 58 is substantially aligned with the front edge of the spring member 56, and the rear end of the wedge member 58 is substantially aligned with the rear edge of the spring member 56. The front edge of the wedge member 58 may be deformed by the application tooling as the wedge member 58 approaches the final position, thereby forming a wedge lock to resist backing out of the wedge member 58 with respect to the spring member 56. Additionally, the amount of deflection of the ends of the spring member 56 is determined by the size of the conductors 52 and 54. For example, the deflection is greater for the larger diameter conductors 52 and 54.

As shown in FIG. 1, the wedge member 58 has a height $H_W$, while the spring member 56 has a height $H_C$ between opposing ends of the spring member 56 where the conductors 52, 54 are received. The tap conductor 52 has a first diameter $D_1$ and the main conductor 54 has a second diameter $D_2$ that may be the same or different from $D_1$. As is evident from FIG. 1, $H_W$ and $H_C$ are selected to produce interference between each end of the spring member 56 and the respective conductor 52, 54. Specifically, the interference I is established by the relationship:

$$I=H_W+D_1+D_2-H_C \tag{1}$$

With strategic selection of $H_W$ and $H_C$ the actual interference I achieved may be varied for different diameters $D_1$ and $D_2$ of the conductors 52 and 54. Alternatively, $H_W$ and $H_C$ may be selected to produce a desired amount of interference I for various diameters $D_1$ and $D_2$ of the conductors 52 and 54. For example, for larger diameters $D_1$ and $D_2$ of the conductors 52 and 54, a smaller wedge member 58 having a reduced height $H_W$ may be selected. Alternatively, a larger spring member 56 having an increased height $H_C$ may be selected to accommodate the larger diameters $D_1$ and $D_2$ of the conductors 52 and 54. As a result, a user requires multiple sized wedge members 52 and/or spring members 56 in the field to accommodate a full range of diameters $D_1$ and $D_2$ of the conductors 52 and 54. Consistent generation of at least a minimum amount of interference I results in a consistent application of applied force $F_A$ which will now be explained in relation to FIG. 3.

Figure 3:
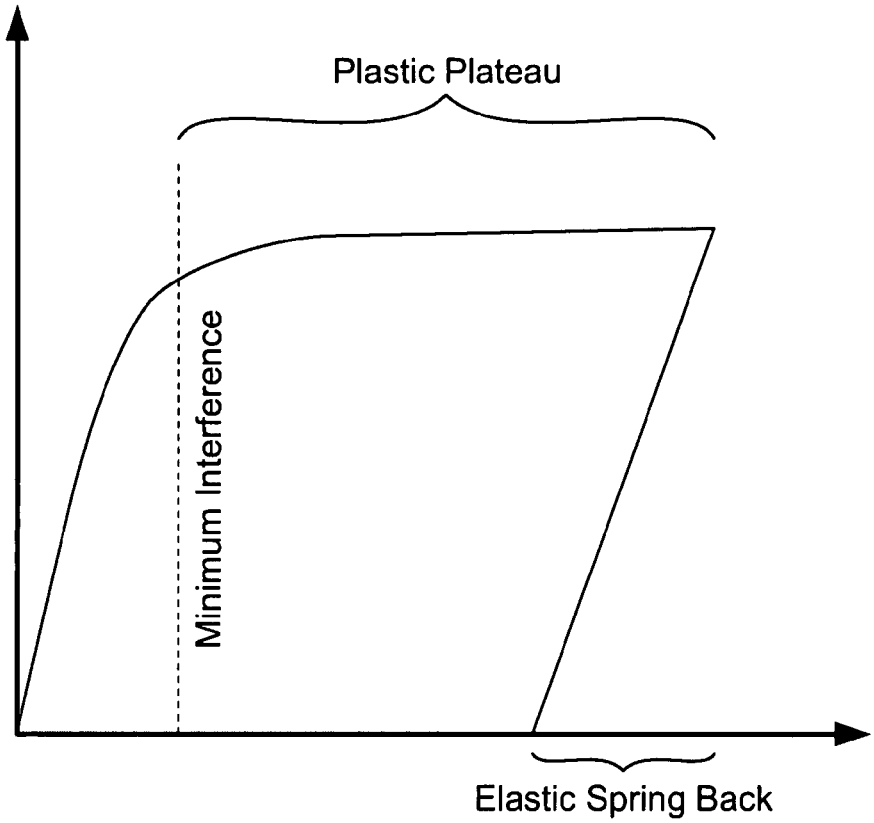
FIG. 3 is a force/displacement graph for the assembly shown in FIG. 1.

FIG. 3 illustrates an exemplary force versus displacement curve for the assembly 50 shown in FIG. 1. The vertical axis represents the applied force and the horizontal axis represents displacement of the ends of the spring member 56 as the wedge member 58 is driven into engagement with the conductors 52, 54 and the spring member 56. As FIG. 3 demonstrates, a minimum amount of interference, indicated in FIG. 3 with a vertical dashed line, results in plastic deformation of the spring member 56 that, in turn, provides a consistent clamping force on the conductors 52 and 54, indicated by the plastic plateau in FIG. 3. The plastic and elastic behavior of the spring member 56 is believed to provide repeatability in clamping force on the conductors 52 and 54 that is not possible with known bolt-on connectors or compression connectors. A need for an inventory of differently sized spring members 56 and wedge members 58 renders the connector assembly 50 more expensive and less convenient than some user's desire.

Figure 4:
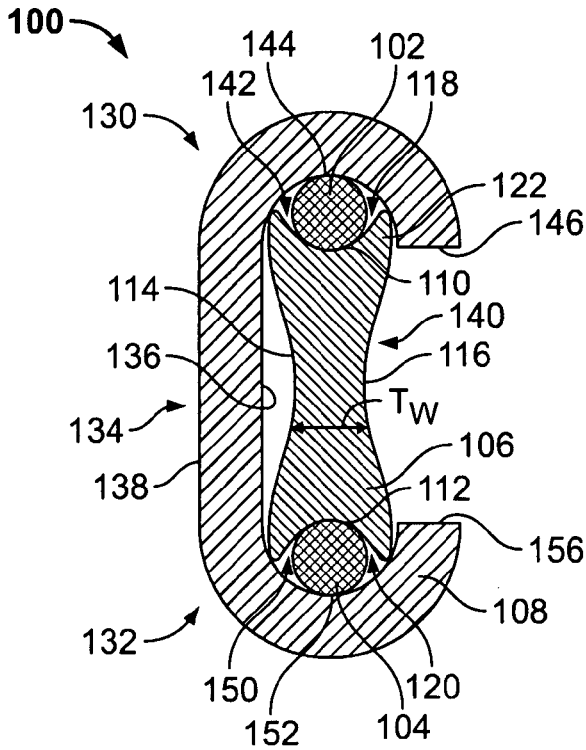
FIG. 4 is a cross sectional view of an exemplary wedge connector assembly formed in accordance with an exemplary embodiment.

FIG. 4 is a cross sectional view of a wedge connector assembly 100 formed in accordance with an exemplary embodiment, and illustrates a tap conductor 102 and a main conductor 104 being connected to one another using a wedge member 106 and a spring member 108. The connector assembly 100 is adapted for use as a tap connector for connecting the tap conductor 102 to the main conductor 104 of a utility power distribution system and overcomes at least the disadvantages described above with respect to conventional connector assemblies. As explained in detail below, the connector assembly 100 provides superior performance and reliability to known bolt-on and compression connectors, while providing greater range taking capability to known wedge connector systems.

The tap conductor 102, sometimes referred to as a distribution conductor, may be a known high voltage cable or line having a generally cylindrical form in an exemplary embodiment. The main conductor 104 may also be a generally cylindrical high voltage cable line. The tap conductor 102 and the main conductor 104 may be of the same wire gauge or different wire gauge in different applications and the connector assembly 100 is adapted to accommodate a range of wire gauges for each of the tap conductor 102 and the main conductor 104.

When installed to the tap conductor 102 and the main conductor 104, the connector assembly 100 provides electrical connectivity between the main conductor 104 and the tap conductor 102 to feed electrical power from the main conductor 104 to the tap conductor 102 in, for example, an electrical utility power distribution system. The power distribution system may include a number of main conductors 104 of the same or different wire gauge, and a number of tap conductors 102 of the same or different wire gauge. The connector assembly 100 may be used to provide tap connections between main conductors 104 and tap conductors 102 in the manner explained below.

As shown in FIG. 4, the connector assembly 100 includes the wedge member 106 and the C-shaped spring member 108 that couples the tap conductor 102 and the main conductor 104 to one another. In an exemplary embodiment, the wedge member 106 includes first and second sides 110 and 112, respectively, which extend between a top 114 and a bottom 116. A thickness $T_w$ is defined between the top 114 and the bottom 116. Each of the first and second sides 110 and 112 include concave indentations that represent conductor receiving channels, identified generally at 118 and 120, respectively. The channels 118, 120 have a predetermined radius that cups the conductors 102, 104 to position the conductors 102, 104 with respect to the spring member 108. The formation and geometry of the wedge member 106 provides for interfacing with differently sized conductors 102, 104 while achieving a repeatable and reliable interconnection of the wedge member 106 and the conductors 102, 104. In an exemplary embodiment, lips 122 of the channels 118, 120 are spaced apart to accommodate differently sized conductors 102, 104. In one embodiment, the channels 118 and 120 are substantially identically formed and share the same geometric profile and dimensions to facilitate capturing of the conductors 102 and 104 between the wedge member 106 and the spring member 108 during mating. The channels 118 and 120, however, may be differently dimensioned as appropriate to be engaged to differently sized conductors 102, 104 while maintaining substantially the same shape of the wedge member 106. In an exemplary embodiment, the depths of the channels 118, 120 are selected to be less than one half of the diameter of the conductors 102 and 104. As such, the sides 110 and 112 do not interfere with the spring member 108, thus the force of the spring member 108 is applied entirely to the conductors 102 and 104.

The C-shaped spring member 108 includes a first hook portion 130, a second hook portion 132, and a central portion 134 extending therebetween. The spring member 108 further includes an inner surface 136 and an outer surface 138. The spring member 108 forms a chamber 140 defined by the inner surface 136 of the spring member 108. The conductors 102, 104 and the wedge member 106 are received in the chamber 140 during assembly of the connector assembly 100. In the illustrated embodiment, the top 114 of the wedge member 106 generally faces and/or engages the inner surface 136 of the central portion 134. Alternatively, as described in further detail below, the wedge member 106 may be oppositely oriented, or flipped, within the chamber 140 such that the bottom 116 of the wedge member 106 generally faces and/or engages the inner surface 136 of the central portion 134.

In an exemplary embodiment, the first hook portion 130 forms a first contact receiving portion or cradle 142 positioned at an end of the chamber 140. The cradle 142 is adapted to receive the tap conductor 102 at an apex 144 of the cradle 142. A distal end 146 of the first hook portion 130 includes a radial bend that wraps around the tap conductor 102 for about 180 circumferential degrees in an exemplary embodiment, such that the distal end 146 faces toward the second hook portion 132. Similarly, the second hook portion 132 forms a second contact receiving portion or cradle 150 positioned at an opposing end of the chamber 140. The cradle 142 is adapted to receive the main conductor 104 at an apex 152 of the cradle 150. A distal end 156 of the second hook portion 132 includes a radial bend that wraps around the main conductor 104 for about 180 circumferential degrees in an exemplary embodiment, such that the distal end 156 faces toward the first hook portion 130. The spring member 108 may be integrally formed and fabricated from extruded metal in a relatively straightforward and low cost manner.

Figure 5:
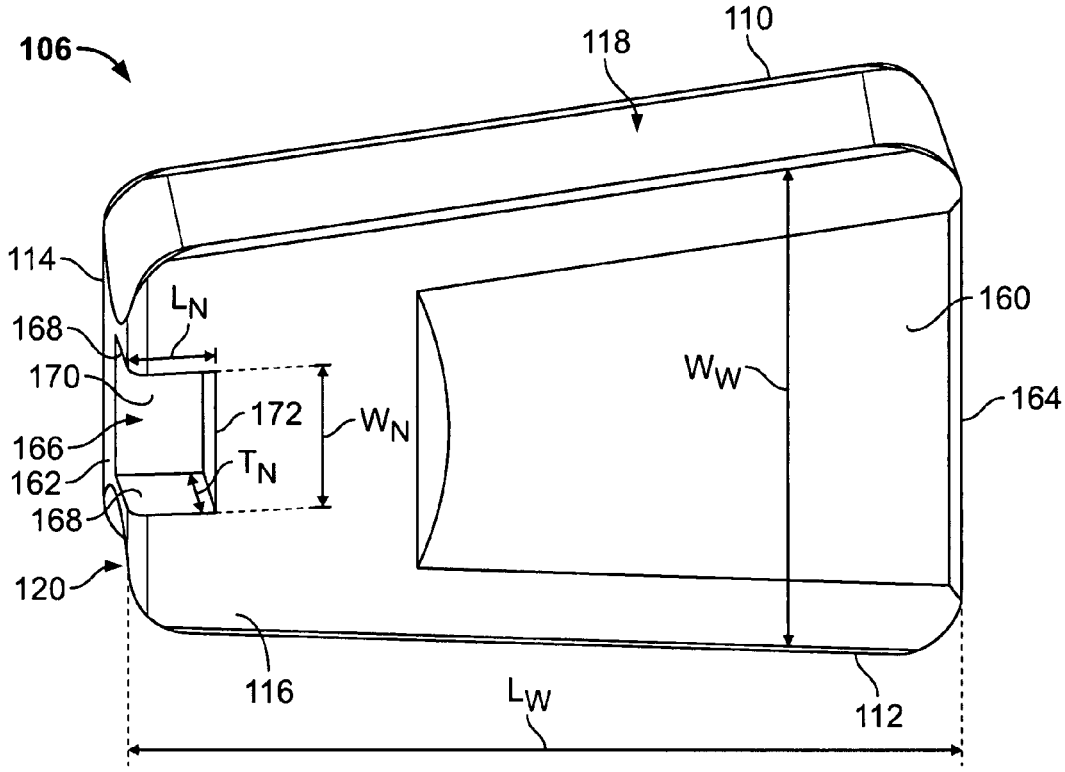
FIG. 5 is a bottom perspective view of a wedge member for the wedge connector assembly shown in FIG. 4 and formed in accordance with an exemplary embodiment.

FIG. 5 is a bottom perspective view of the wedge member 106 formed in accordance with an exemplary embodiment. The wedge member 106 includes a body 160 defined by the first and second sides 110 and 112, the top 114, the bottom 116, a leading end 162 and a trailing end 164. The channels 118, 120 extend inward from the first and second sides 110, 112. The first and second sides 110 and 112 are tapered from the trailing end 164 to the leading end 162, such that a cross-sectional width $W_w$ between the first and second sides 110 and 112 is greater proximate the trailing end 164 than the leading end 162. The tapered first and second sides 110 and 112 form a wedge shaped body for the wedge member 106. The wedge member 106 has a length $L_w$ measured between the leading end 162 and the trailing end 164. In an exemplary embodiment, the length $L_w$ is between approximately two and three inches, however, it is realized that the length $L_w$ may be greater than three inches or less than two inches in alternative embodiments.

A notch 166 extends into the body 160 from the leading end 162 and from the bottom 116. In the illustrated embodiment, the notch 166 is box-shaped and is defined by side walls 168, a top wall 170 and a base wall 172. The notch 166 has an open face at the leading end 162 and another open face at the bottom 116. The side walls 168 extend from the open face at the leading end 162 to the base wall 172, and are parallel to the sides 110, 112 of the wedge member 106. The top wall 170 extends from the open face at the leading end 162 to the base wall 172, and is parallel to the top 114 of the wedge member 106. The base wall 172 extends from the open face at the bottom 116 to the top wall 170, and is parallel to the leading end 162. Other shaped notches are possible in alternative embodiments. The notch 166 has a length $L_n$ measured from the open face at the leading end 162 to the base wall 172, a width $W_n$ measured between the opposed side walls 168, and a thickness $T_n$ measured from the open face at the bottom 116 to the top wall 170. In an exemplary embodiment, the notch 166 is sized and shaped to receive a portion of an application tool to control a mating depth of the wedge member 106 with respect to the spring member 108 (shown in FIG. 4), as will be described in more detail below. In an alternative embodiment, two or more notches 166 are provided to provide more final mating positions. For example, the notches 166 may be offset with respect to one another and/or one notch 166 may extend from the bottom 116 and another notch may extend from the top 114.

Figure 6:
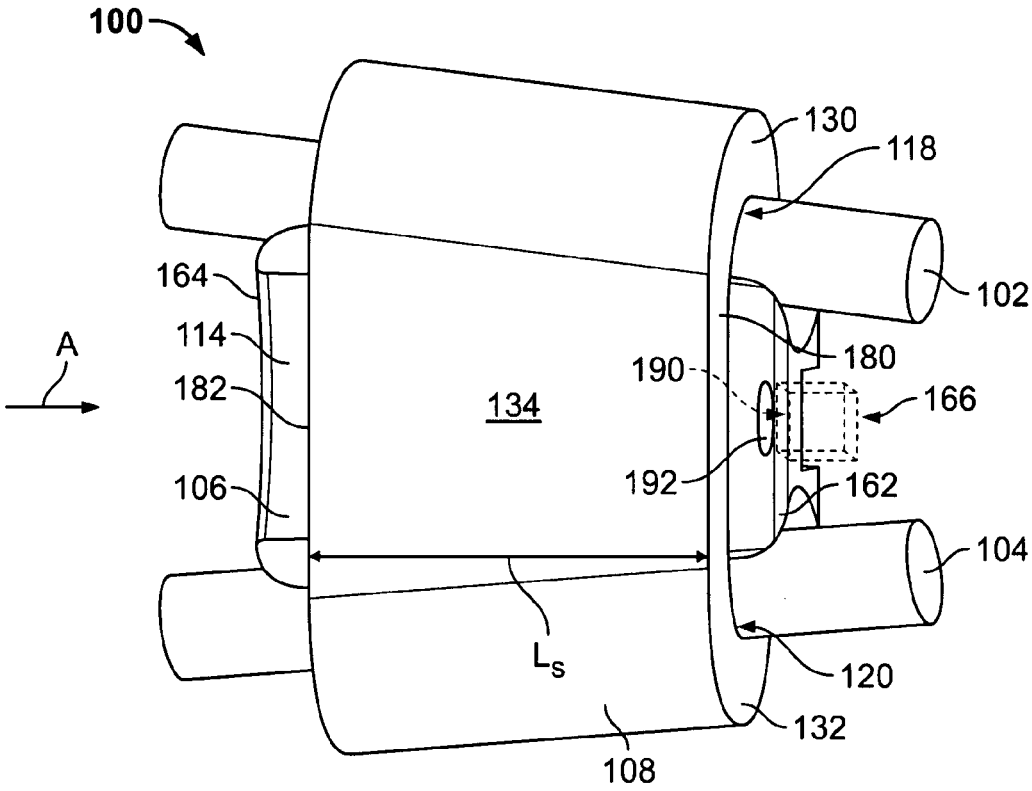
FIG. 6 is a perspective view of the wedge connector assembly shown in FIG. 4 illustrating a wedge member and a spring member in a first orientation.
Figure 7:
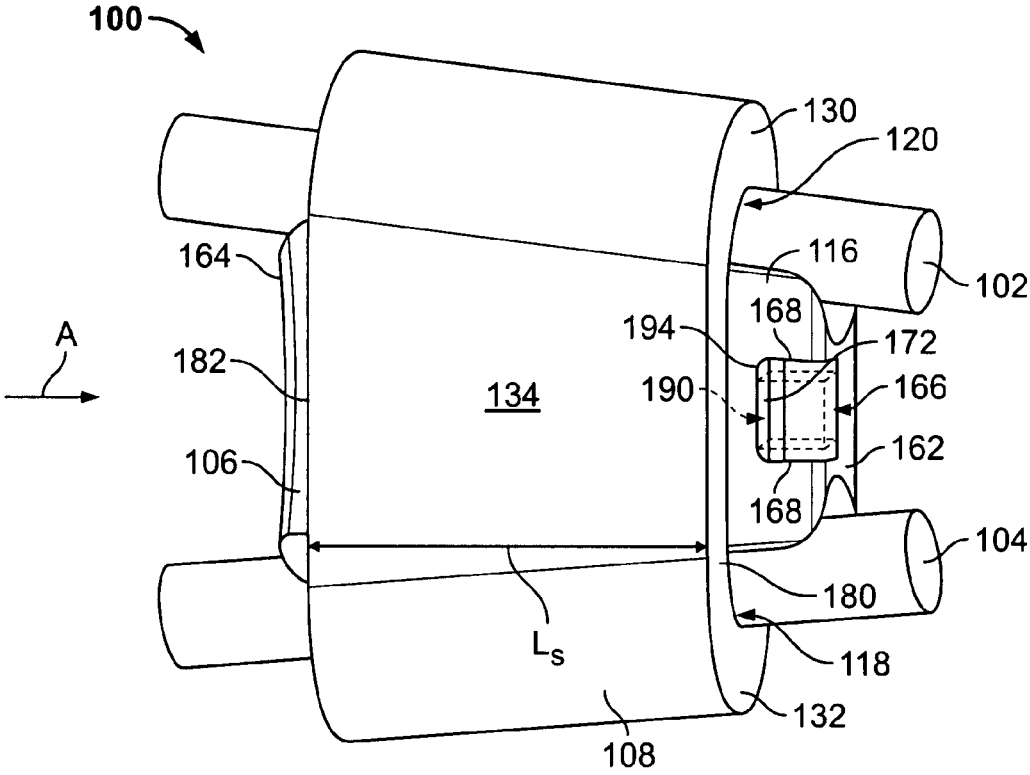
FIG. 7 is a perspective view of the wedge connector assembly shown in FIG. 4 illustrating a wedge member and a spring member in a second orientation.

An exemplary operation of the wedge connector assembly 100 will be described with reference to FIGS. 6 and 7. FIG. 6 is a perspective view of the wedge connector assembly 100 illustrating the wedge member 106 and the spring member 108 mated in a first orientation. FIG. 7 is a perspective view of the wedge connector assembly 100 illustrating the wedge member 106 and the spring member 108 mated in a second orientation. As described in further detail below, the final mated position depends upon the orientation of the wedge member 106 with respect to the spring member 108. For example, the wedge member 106 has more than one final mated position depending on the mating orientation of the wedge member 106 with respect to the spring member 108. By having more than one mating position, the connector assembly 100 may accommodate multiple conductor sizes and the wedge member 106 may replace multiple wedges of conventional connector assemblies.

The spring member 108 includes a leading edge 180 and a trailing edge 182. The first and second hook portions 130 and 132 are tapered from the trailing edge 182 to the leading edge 180. The spring member 108 has a length $L_s$ measured between the leading edge 180 and the trailing edge 182. In an exemplary embodiment, the length $L_s$ is between approximately one and a half and two inches. The spring member length $L_s$ is less than the wedge member length $L_w$ such that the wedge member 106 may be positioned at multiple positions with respect to the spring member 108 during use of the connector assembly 100, as will be described in further detail below.

The wedge member 106 and the spring member 108 are separately fabricated from one another or otherwise formed into discrete connector components and are assembled to one another as explained below. While one exemplary shape of the wedge and spring members 106, 108 has been described herein, it is recognized that the members 106, 108 may be alternatively shaped in other embodiments as desired.

During assembly of the connector assembly 100, the tap conductor 102 and the main conductor 104 are positioned within the chamber 140 (shown in FIG. 4) and placed against the inner surface 136 (shown in FIG. 4) of the first and second hook portions 130 and 132, respectively. The wedge member 106 is then aligned with the trailing edge 182 of the spring member 108 and the leading end 162 is loaded into the chamber 140 through the trailing edge 182, such as in the direction of arrow A. In an initially loaded position, the conductors 102, 104 are held tightly between the wedge member 106 and the spring member 108 but the spring member 108 remains largely un-deformed. Optionally, the hook portions 130, 132 of the spring member 108 may be partially deflected outward. In an exemplary embodiment, the wedge member 106 is pressed hand-tight within the spring member 108 by the user such that the spring member 108 is minimally deflected. By pressing hand-tight, a user is able to exert an applied force $F_a$ to the spring member 108 on the order of 100 lbs of clamping force against the conductors 102, 104.

The wedge member 106 may be loaded in more than one orientation. In a first orientation, as illustrated in FIG. 6, the top 114 of the wedge member 106 is positioned along the inner surface 136 of the central portion 134. In the first orientation, the open side of the notch 166 faces away from the central portion 134. In a second orientation, as illustrated in FIG. 7, the wedge member 106 is flipped with respect to the spring member 108. The bottom 116 of the wedge member 106 is positioned along the inner surface 136 of the central portion 134. In the second orientation, the open side of the notch 166 faces and travels along the central portion 134 as the wedge member 106 is loaded into the chamber 140.

The final mated position of the wedge member 106 is based on the initial loading orientation of the wedge member 106. The first orientation corresponds to a first final mated position, which is illustrated in FIG. 6. The second orientation corresponds to a second final mated position, which is illustrated in FIG. 7. It is realized that the positions illustrated in FIGS. 6 and 7 are exemplary and may vary in alternative embodiments. As will be evident from the discussion below, the connector assembly 100 may accommodate different sized or gauged conductors 102, 104 depending on the mated position of the wedge member 106. During mating of the wedge member 106 and the spring member 108, an application tool (not shown) is used to force the wedge member 106 to the final mated position. As the wedge member 106 is pressed into the spring member 108, the hook portions 130, 132 are deflected outward. In one embodiment, the application tool presses against the trailing end 164 of the wedge member 106 until the wedge member 106 engages a stop 190 (shown in phantom in FIGS. 6 and 7) of the application tool. The stop 190 is positioned proximate the leading edge 180 of the spring member 108. Optionally, when the wedge member 106 engages the stop 190, a portion of the wedge member 106 is deformed by the stop 190 to form a wedge lock.

As illustrated in FIG. 6, in the first final mated position, the leading end 162 of the wedge member 106 is substantially aligned with the leading edge 180 of the spring member 108. The trailing end 164 of the wedge member 106 is positioned remote with respect to the trailing edge 182, such that a portion of the wedge member 106 remains exposed beyond the trailing edge 182. Optionally, between approximately ¼ and ½ of an inch of the wedge member 106 remains exposed beyond the trailing edge 182. In the first final mated position, the stop 190 forms the wedge lock 192 by deforming a portion of the leading end 162. Optionally, the wedge lock 192 may be represented by a lip that extends outward from the top 114 of the wedge member 106. The lip may engage the leading edge 180 of the spring member 108 to resist movement of the wedge member 106 with respect to the spring member 108.

In the first final mated position, the tap conductor 102 is captured between the channel 118 of the wedge member 106 and the inner surface 136 of the first hook portion 130. Likewise, the main conductor 104 is captured between the channel 120 of the wedge member 106 and the inner surface 136 of the second hook portion 132. As the wedge member 106 is pressed into the chamber 140 of the spring member 108, the hook portions 130, 132 are deflected outward. The spring member 108 is elastically and plastically deflected resulting in a spring back force to provide a clamping force on the conductors 102, 104. A large application force, on the order of about 4000 lbs of clamping force is provided in an exemplary embodiment, and the clamping force ensures adequate electrical contact force and connectivity between the connector assembly 100 and the conductors 102, 104. Additionally, elastic deflection of the spring member 108 provides some tolerance for deformation or compressibility of the conductors 102, 104 over time, such as when the conductors 102, 104 deform due to compression forces. Actual clamping forces may be lessened in such a condition, but not to such an amount as to compromise the integrity of the electrical connection.

As illustrated in FIG. 7, in the second final mated position, the leading end 162 of the wedge member 106 is positioned remote with respect to the leading edge 180, such that a portion of the wedge member 106 remains exposed beyond the leading edge 180. Optionally, between approximately ¼ and ½ of an inch of the wedge member 106 remains exposed beyond the leading edge 180. The notch 166 is exposed in the second final mated position. In an exemplary embodiment, the base wall 172 is substantially aligned with the leading edge 182 of the spring member 108. During assembly, by orienting the wedge member 106 such that the notch 166 extends along the inner surface 136 of the spring member 108, the notch 166 receives the stop 190 as the wedge member 106 is pressed into the spring member 108. The notch 166 provides a space for the stop 190, which allows the wedge member 106 to travel a further distance in the loading direction (arrow A) with respect to the spring member 108 during assembly. In the second final mated position, the stop 190 forms the wedge lock 194 by deforming a portion of the base wall 172 and/or the side walls 168 of the notch 166. Optionally, the wedge lock 194 may be represented by a lip that extends outward from the bottom 116 of the wedge member 106. The lip may engage the leading edge 180 of the spring member 108 to resist movement of the wedge member 106 with respect to the spring member 108. Optionally, in the second final mated position, the trailing end 164 may be substantially aligned with the trailing edge 182.

In the second final mated position, the tap conductor 102 is captured between the channel 120 of the wedge member 106 and the inner surface 136 of the first hook portion 130. Likewise, the main conductor 104 is captured between the channel 118 of the wedge member 106 and the inner surface 136 of the second hook portion 132. As the wedge member 106 is pressed into the chamber 140 of the spring member 108, the spring member 108 is elastically and plastically deflected resulting in a spring back force to provide a clamping force on the conductors 102, 104, in a similar manner as described above. Because the amount of travel of the wedge member 106 is greater when the wedge member 106 is in the second orientation, the portion of the wedge member 106 received within the envelope of the spring member 106 is generally wider. As such, the wedge member 106 may accommodate different, smaller sized conductors 102, 104 when the wedge member 106 is in the second orientation. The wedge member 106 may provide a relatively larger application or clamping force between the connector assembly 100 and the conductors 102, 104 when the wedge member 106 is in the second orientation.

Figure 8:
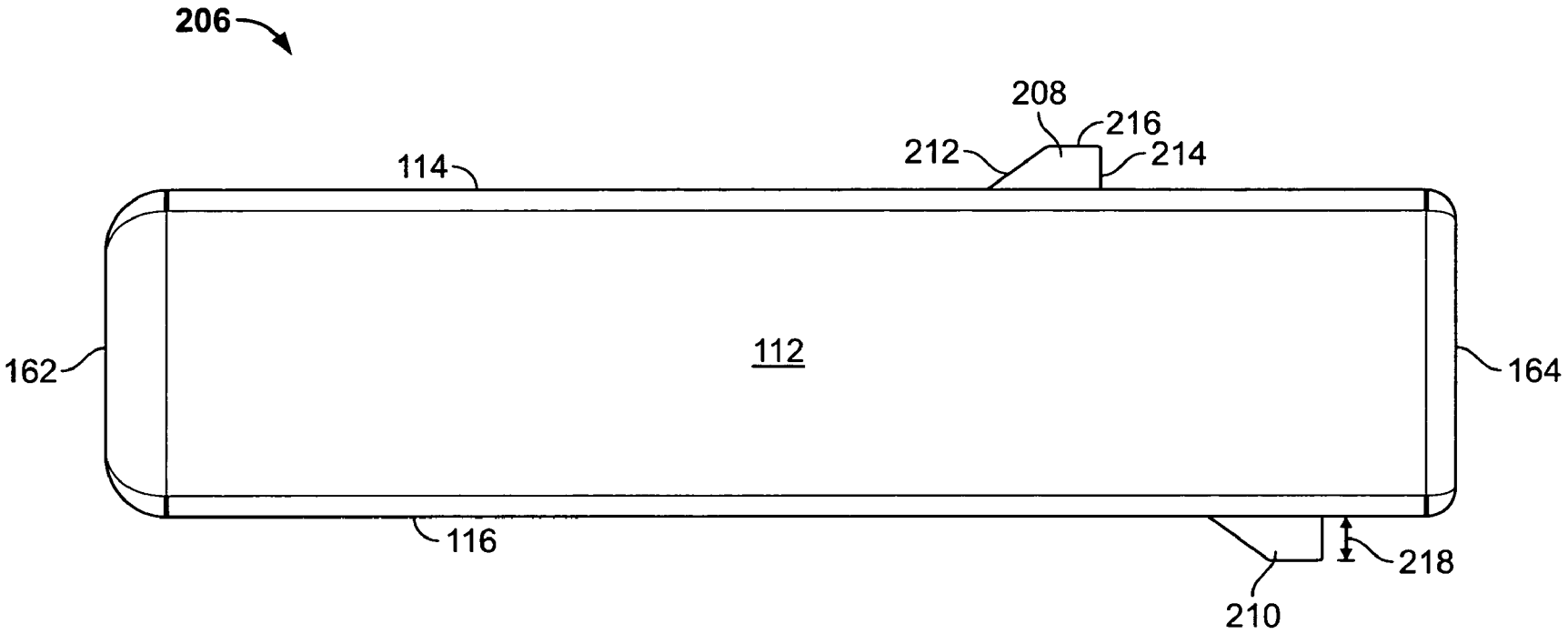
FIG. 8 is a side view of an alternative wedge member.

FIG. 8 is a side view of a wedge member 206 formed in accordance with an alternative embodiment. The wedge member 206 is similar to the wedge member 106, and like reference numerals are used to identify like components. The wedge member 206 includes the top 114 and the bottom 116, which extend between the leading end 162 and the trailing end 164. The wedge member 206 extends longitudinally between the leading and trailing ends 162, 164. The second side 112 is illustrated in FIG. 8. A first barb 208 extends outward from the top 114 and a second barb 210 extends outward from the bottom 116. The first and second barbs 208, 210 are offset or staggered along the longitudinal length of the wedge member 206 such that the first barb 208 is positioned a first distance from the leading end 162 and the second barb 210 is positioned a second, further distance from the leading end 162.

The first and second barbs 208, 210 each include a leading ramp surface 212 facing the leading end 162, and a rear surface 214 facing the trialing end 164. The rear surface 212 extends substantially perpendicular to the respective top 114 or bottom 116. A planar outer surface 216 extends between the leading ramp surface 212 and the rear surface 214. The outer surface 216 is oriented substantially parallel to the top 114 or bottom 116. The barbs 208, 210 may have other shapes in alternative embodiments. For example, the leading ramp surface 212 may be curved, may have a more gradual slope than the slope depicted, may have a steeper slope than the slope depicted, or may be provided in multiple sections having different slopes. The rear surface 214 may be non-perpendicular with respect to the top 114 or the bottom 116, and may be sloped. Optionally, the rear surface 214 may be sloped in the opposite direction as the leading ramp surface 212, or alternatively, the rear surface 214 may be sloped in the same direction as the leading ramp surface 212. Optionally, the barbs 208, 210 may be devoid of an outer surface 216 such that the leading ramp surface 212 extends to the rear surface 214. The barbs 208, 210 extend outward from the top 114 and bottom 116, respectively for a distance 218. Optionally, the distance 218 may be different for the first barb 208 than the second barb 210.

Figure 9:
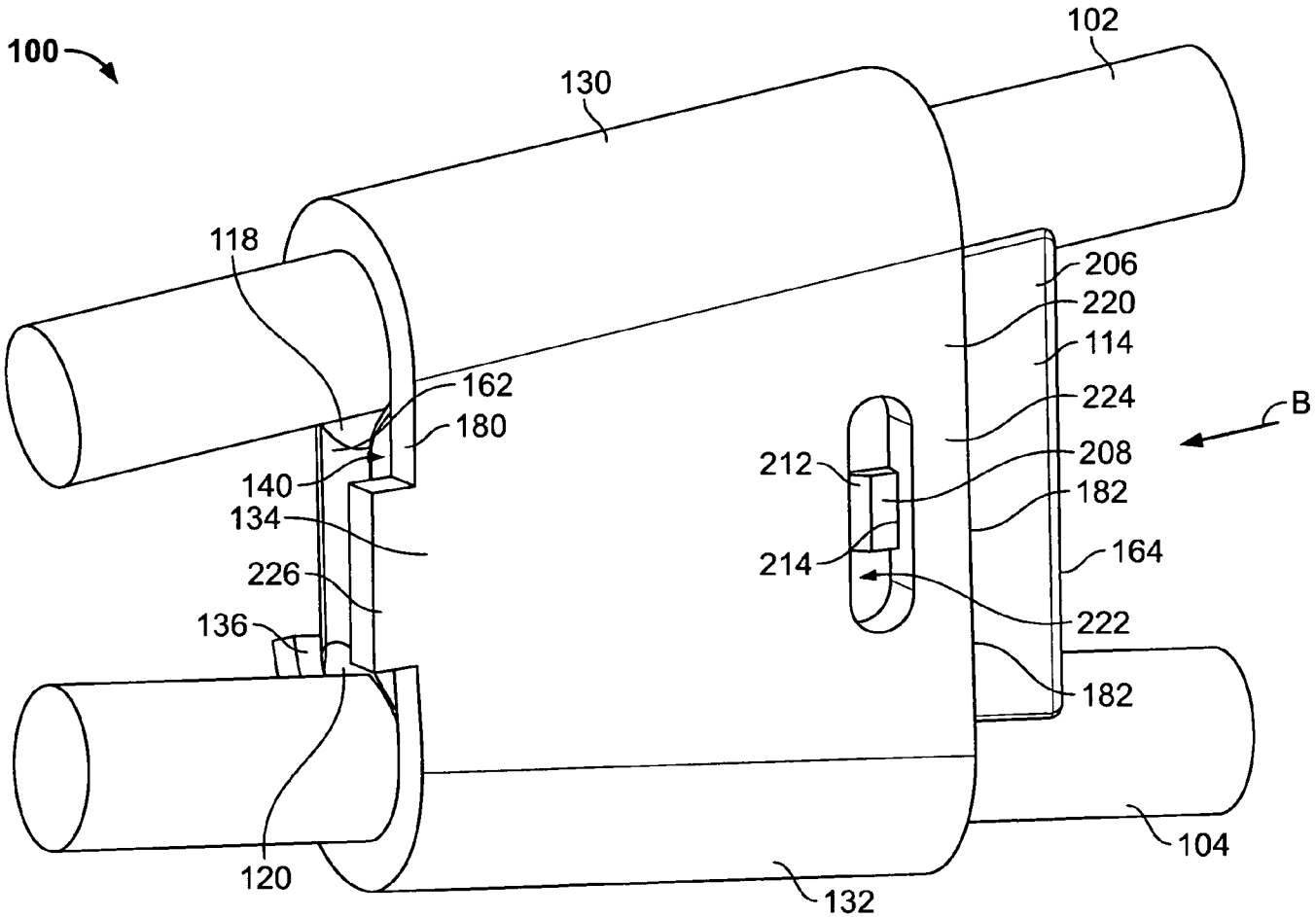
FIG. 9 is a perspective view of the wedge connector assembly formed in accordance with an alternative embodiment illustrating the wedge member shown in FIG. 8 and a spring member mated in a first orientation.
Figure 10:
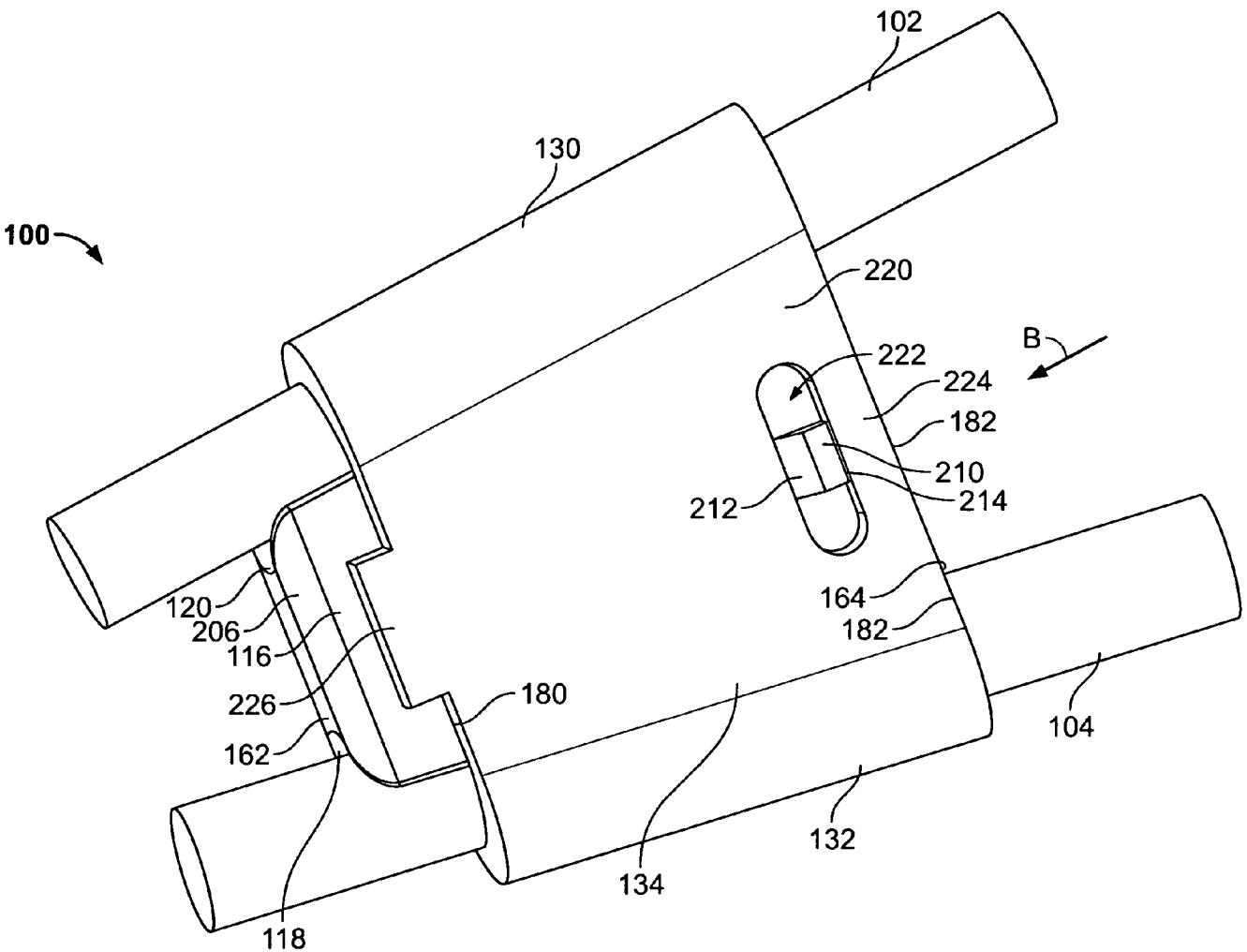
FIG. 10 is a perspective view of the wedge connector assembly shown in FIG. 9 illustrating the wedge member and the spring member mated in a second orientation.

An exemplary operation of the wedge connector assembly 100 will be described with reference to FIGS. 9 and 10. FIG. 9 is a perspective view of the wedge connector assembly 100 illustrating the wedge member 206 and a spring member 220 mated in a first orientation. FIG. 10 is a perspective view of the wedge connector assembly 100 illustrating the wedge member 206 and the spring member 220 mated in a second orientation. As described in further detail below, the final mated position depends upon the orientation of the wedge member 206 with respect to the spring member 220. For example, the wedge member 206 has more than one final mated position depending on the mating orientation of the wedge member 206 with respect to the spring member 220. In the first orientation, the wedge member 206 is driven to a first mating depth with respect to the spring member 220, whereas the wedge member 206 is driven to a second mating depth in the second orientation. As such, and as explained in further detail below, the mating depth of the wedge member 206 is controlled by the orientation of the wedge member 206 with respect to the spring member 220. By having more than one mating position, the connector assembly 100 may accommodate multiple conductor sizes and the wedge member 206 may replace multiple wedges of conventional connector assemblies.

The spring member 220 is similar to the spring member 108, and like reference numerals are used to identify like components. The spring member 220 includes the first hook portion 130, the second hook portion 132, and the central portion 134 extending therebetween. The spring member 220 forms the chamber 140 (shown in FIG. 9) defined by the inner surface 136 (shown in FIG. 9). The conductors 102, 104 and the wedge member 206 are received in the chamber 140 during assembly of the connector assembly 100. In the illustrated embodiment of FIG. 9, the top 114 of the wedge member 206 generally faces and/or engages the inner surface 136 of the central portion 134. Alternatively, as described in further detail below with respect to FIG. 10, the wedge member 206 may be oppositely oriented, or flipped, within the chamber 140 such that the bottom 116 of the wedge member 206 generally faces and/or engages the inner surface 136 of the central portion 134.

The spring member 220 includes an opening 222 extending through the central portion 134. The opening 222 is sized, shaped and positioned to receive either the first barb 208, such as when the wedge member 206 is positioned in the first orientation (FIG. 9), or the second barb 210, such as when the wedge member 206 is positioned in the second orientation (FIG. 10). Optionally, the opening 222 may extend only partially through the central portion, such that the barb 208 is not exposed when the barb 208 is received in the opening 222. Alternatively, and as illustrated in the Figures, the opening extends entirely through the central portion 134. In an exemplary embodiment, the opening 222 is positioned proximate to the trailing edge 182 and the spring member 220 defines a web portion 224 between the opening 222 and the trailing edge 182. The web portion 224 is formed integrally with the spring member 220, however the web portion 224 may be a separate component attached to the spring member 220 in alternative embodiments. The opening 222 is positioned a predetermined distance from the trailing edge 182, which defines the thickness of the web portion 224. The opening has a width perpendicular to the trailing edge 182, which defines a width of the web portion 224. The thickness and width of the web portion 224 are selected to provide some flexing of the web portion 224 to a deflected or flexed position. The barbs 208 or 210 are allowed to pass below the web portion 224 when the web portion 224 is in the deflected position.

During assembly, the tap conductor 102 and the main conductor 104 are positioned within the chamber 140 and placed against the inner surface 136 of the first and second hook portions 130 and 132, respectively. The wedge member 206 is then aligned with the trailing edge 182 of the spring member 220 and the leading end 162 is loaded into the chamber 140 through the trailing edge 182, such as in the direction of arrow B. In an initially loaded position, the conductors 102, 104 are held tightly between the wedge member 206 and the spring member 220 but the spring member 220 remains largely un-deformed. Optionally, the hook portions 130, 132 of the spring member 220 may be partially deflected outward. In an exemplary embodiment, the wedge member 206 is pressed hand-tight within the spring member 220 by the user such that the spring member 220 is minimally deflected.

The wedge member 206 may be loaded in more than one different orientation. In a first orientation, as illustrated in FIG. 9, the top 114 of the wedge member 206 is positioned along the inner surface 136 of the central portion 134. In the first orientation, the first barb 208 faces and travels along the central portion 134 as the wedge member 206 is loaded into the chamber 140. In a second orientation, as illustrated in FIG. 10, the wedge member 206 is flipped with respect to the spring member 220. The bottom 116 of the wedge member 206 is positioned along the inner surface 136 of the central portion 134. In the second orientation, the second barb 210 faces and travels along the central portion 134 as the wedge member 206 is loaded into the chamber 140. In alternative embodiments, the orientation of the wedge member 206 with respect to the spring member 220 may be varied in ways other than flipping the wedge member 206 with respect to the spring member 220. For example, the wedge member may have different final mating positions by driving the wedge member 206 into the spring member 220 to a different depth.

The final mated position (e.g. the depth of loading) of the wedge member 206 is based on the initial loading orientation of the wedge member 206. The first orientation corresponds to a first final mated position, which is illustrated in FIG. 9. The second orientation corresponds to a second final mated position, which is illustrated in FIG. 10. It is realized that the positions illustrated in FIGS. 9 and 10 are exemplary and may vary in alternative embodiments. As will be evident from the discussion below, the connector assembly 100 may accommodate different sized or gauged conductors 102, 104 depending on the mated position of the wedge member 206.

During mating of the wedge member 206 and the spring member 220, an application tool (not shown), such as an adjustable jaw pliers tool, is used to force the wedge member 206 to the final mated position. As the wedge member 206 is pressed into the spring member 220, the hook portions 130, 132 are deflected outward. In one embodiment, the application tool engages a tip portion 226 of the spring member 220 that extends from the leading edge 180 and presses against the trailing end 164 of the wedge member 206 to force the wedge member 206 in the loading direction. As the wedge member 206 is loaded into the spring member 220, the barb 208 or 210 engages the trailing edge 182. The leading ramp surface 212 engages and deflects the web portion 224 of the spring member 220 until the barb 208 or 210 is received within the opening 222. When the barb 208, 210 is received within the opening 222, the wedge member 206 is fully loaded and positioned in the final mated position. As such, the opening 222 may operate as a viewing window for a user to visually verify that the wedge member 206 is fully loaded into the spring member 220. When the rear end 214 of the barb 208 or 210 passes from the web portion 224, the web portion 224 returns to an un-deflected state and operates as a stop to limit removal of the wedge member 206 from the spring member 220. As such, the barb locks the wedge member 206 into position with respect to the spring member 220. When the web portion 224 returns to the un-deflected state, the user may hear an audible snap indicating that the wedge member 206 is fully loaded.

As illustrated in FIG. 9, in the first final mated position, the leading end 162 of the wedge member 206 is substantially aligned with the leading edge 180 of the spring member 220. The leading end 162 of the wedge member 206 may be partially recessed from the leading edge 180, or may extend slightly beyond the leading edge 180 in alternative embodiments. The position of the leading end 162 with respect to the leading edge 180 depends on the distance from the leading end 162 to the barb 208 and the position of the opening 222 on the spring member 220. In the first final mated position, the trailing end 164 of the wedge member 206 is positioned remote with respect to the trailing edge 182, such that a portion of the wedge member 206 remains exposed beyond the trailing edge 182. Optionally, between approximately ¼ and ½ of an inch of the wedge member 206 remains exposed beyond the trailing edge 182. The position of the trailing end 164 with respect to the trailing edge 182 depends on the distance from the leading end 162 to the barb 208 and the position of the opening 222 on the spring member 220.

In the first final mated position, the tap conductor 102 is captured between the channel 118 of the wedge member 206 and the inner surface 136 of the first hook portion 130. Likewise, the main conductor 104 is captured between the channel 120 of the wedge member 206 and the inner surface 136 of the second hook portion 132. As the wedge member 206 is pressed into the chamber 140 of the spring member 220, the hook portions 130, 132 are deflected outward. The spring member 220 is elastically and plastically deflected resulting in a spring back force to provide a clamping force on the conductors 102, 104. The clamping force ensures adequate electrical contact force and connectivity between the connector assembly 100 and the conductors 102, 104. Additionally, elastic deflection of the spring member 220 provides some tolerance for deformation or compressibility of the conductors 102, 104 over time, such as when the conductors 102, 104 deform due to compression forces. Actual clamping forces may be lessened in such a condition, but not to such an amount as to compromise the integrity of the electrical connection.

As illustrated in FIG. 10, in the second final mated position, the leading end 162 of the wedge member 206 is positioned remote with respect to the leading edge 180, such that a portion of the wedge member 206 is exposed beyond the leading edge 180. Optionally, between approximately ¼ and ½ of an inch of the wedge member 206 is exposed beyond the leading edge 180. The position of the trailing end 164 with respect to the trailing edge 182 depends on the distance from the leading end 162 to the barb 208 and the position of the opening 222 on the spring member 220. Optionally, in the second final mated position, the trailing end 164 may be substantially aligned with the trailing edge 182. The trailing end 164 of the wedge member 206 may be partially recessed from the trailing edge 182, or may extend slightly beyond the trailing edge 182 in alternative embodiments. The position of the leading end 162 with respect to the leading edge 180 depends on the distance from the leading end 162 to the barb 208 and the position of the opening 222 on the spring member 220.

In the second final mated position, the tap conductor 102 is captured between the channel 120 of the wedge member 206 and the inner surface 136 of the first hook portion 130. Likewise, the main conductor 104 is captured between the channel 118 of the wedge member 206 and the inner surface 136 of the second hook portion 132. Because the amount of travel of the wedge member 206 is greater when the wedge member 206 is in the second orientation, the portion of the wedge member 206 received within the envelope of the spring member 206 is generally wider. As such, the wedge member 206 may accommodate different, smaller sized conductors 102, 104 when the wedge member 206 is in the second orientation.

In an alternative embodiment, a single barb may extend from the inner surface 136 of the spring member 220, and the wedge member 206 may include a slot on each of the top 114 and the bottom 116 of the wedge member 206. The slots may be offset, such as in similar positions as the positions of the barbs 208, 210 in the above described embodiment. The wedge member 206 may be loaded in a first orientation to a first loaded position, wherein the slot on the top 114 engages the barb extending from the inner surface 136. The wedge member may be loaded in a second orientation to a second loaded position, wherein the slot on the bottom 116 engages the barb.

In another alternative embodiment, both barbs 208, 210 may extend from the same surface, such as the top 114 or the bottom 116. The barbs 208, 210 may be longitudinally spaced along the length of the wedge member 206, such that when the wedge member 206 is loaded to a first depth, the first barb 208 is received within the opening 222, and when the wedge member 206 is loaded to a second depth, the second barb 210 is received within the opening 222. Optionally, a second opening may be provided to receive the first barb 208 when the second barb 210 is received within the opening 222. Optionally, the barbs 208, 210 may be laterally off-set with respect to one another and the two openings may similarly be laterally off-set with one another to receive the corresponding barbs 208, 210. In an alternative embodiment, the opening 222 may be large enough to accommodate both barbs 208, 210, such that the rearward-most barb 208 or 210 that is received within the single opening defines the mated position of the wedge member 206 and locks the mating position of the wedge member 206 with respect to the spring member 220. Alternatively, a single barb may be provided and more than one opening may be provided such that the mating depth is determined by which opening receives the barb.

As described above, the wedge and spring members 106, 108 (or 206, 220) may accommodate a greater range of conductor sizes or gauges in comparison to conventional wedge connectors. Additionally, even if several versions of the wedge and spring members 106, 108 (or 206, 220) are provided for installation to different conductor wire sizes or gauges, the assembly 100 requires a smaller inventory of parts in comparison to conventional wedge connector systems, for example, to accommodate a full range of installations in the field. That is, a relatively small family of connector parts having similarly sized and shaped wedge portions may effectively replace a much larger family of parts known to conventional wedge connector systems. Particularly, because the wedge member 106 (or 206) has two different orientations with respect to the spring member 108 (or 220), a single wedge member 106 (or 206) can effectively replace multiple wedge members used in conventional wedge connector systems.

It is therefore believed that the connector assembly 100 provides the performance of conventional wedge connector systems that does not require a large inventory of parts to meet installation needs. The connector assembly 100 may be provided at low cost, while providing increased repeatability and reliability as the connector assembly 100 is installed and used. The combination wedge action of the wedge and spring members 106, 108 (or 206, 220) provides a reliable and consistent clamping force on the conductors 102 and 104 and is less subject to variability of clamping force when installed than either of known bolt-on or compression-type connector systems.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A wedge connector assembly assembled using an application tool that includes a stop, the wedge connector assembly comprising:

a spring member having a generally C-shaped body having an inner surface; and a wedge member having opposed first and second sides extending between a leading end at a front face of the wedge member and a trailing end at a rear face of the wedge member, the wedge member being configured to be mated with the spring member by the application tool wherein the wedge member is configured to securely retain a first conductor between the first side and the spring member and a second conductor between the second side and the spring member when mated with the spring member, the wedge member being driven by the application tool until the leading end of the wedge member engages the stop, the leading end being stepped with different steps being configured to engage the stop such that the wedge member is configured to be driven to at least two final mating positions.

2. A wedge connector assembly in accordance with claim 1, wherein the wedge member has a first orientation with respect to the spring member in a first mating position and the wedge member has a second orientation with respect to the spring member in a second mating position, wherein the first and second sides are flipped with respect to one another in the first and second orientations.

3. A wedge connector assembly in accordance with claim 1, wherein the wedge member further comprises a top and a bottom extending between the sides and between the leading end and the trailing end, wherein the top engages the inner surface in a first orientation and the bottom engages the inner surface in a second orientation.

4. A wedge connector assembly in accordance with claim 1, wherein the wedge member comprises a notch extending inward from the leading end, the notch defining one of the steps of the leading end.

5. A wedge connector assembly in accordance with claim 1, wherein the wedge member and the spring member accommodate a first range of conductor sizes in a first of the mating positions, and wherein the wedge member and the spring member accommodate a second range of conductor sizes in a second of the mating positions.

6. A wedge connector assembly in accordance with claim 1, wherein a travel distance of the wedge member with respect to the spring member is different to reach the at least two final mating positions.

7. A wedge connector assembly in accordance with claim 1, wherein the spring member includes a channel, the wedge member being initially loaded into the channel during mating, and wherein an initial loading orientation of the wedge member with respect to the spring member is reversible.

8. A wedge connector assembly in accordance with claim 1, wherein the wedge member includes a top, a bottom and a notch extending from the leading end along the bottom, the notch having an open face at the leading end and a base wall generally opposed to the open face, the base wall defining one of the steps and the leading end defining another of the steps, the leading end engaging the stop when the wedge member is oriented such that the top faces the spring member and the base wall engaging the stop when the wedge member is oriented such that the bottom faces the spring member.

9. A wedge connector assembly in accordance with claim 1, wherein the portion of the wedge member adjacent the step engage by the stop is deformed by the application tool when the wedge member is mated with the spring member.

10. A wedge connector assembly in accordance with claim 1, wherein the wedge member is driven into the spring member in a loading direction by the application tool during assembly, the leading end being oriented perpendicular to the loading direction.

11. A wedge connector assembly in accordance with claim 1, wherein the first and second sides are angled outward between the leading end and the trailing end such that the leading end is narrower than the trailing end between the first and second sides.

12. A wedge connector assembly in accordance with claim 1, wherein the wedge member extends along a wedge member axis between the leading end and the trailing end, the wedge member being driven along the wedge member axis, the leading end being a forward facing surface oriented perpendicular to the wedge member axis, the leading end having a notch being stepped rearward from the forward facing surface along the wedge member axis.

13. A wedge connector assembly in accordance with claim 1, wherein the wedge member is driven into the spring member in a loading direction by the application tool during assembly, the leading end being positioned forward of the trailing end such that the leading end is loaded through the spring member prior to the trailing end being loaded into the spring member by the application tool during assembly.

14. A wedge connector assembly comprising:

a spring member having a generally C-shaped body having an inner surface; and a wedge member having a top, a bottom and opposed sides tapered between a leading end and a trailing end, the leading end being forward facing, the wedge member further having a notch extending from the leading end along the bottom, the notch having an open face at the leading end and a base wall generally opposed to the open face, wherein the wedge member is configured to be mated to a first mated depth when the notch is in a first orientation with respect to the spring member and wherein the wedge member is configured to be mated to a second mated depth when the notch is in a second orientation with respect to the spring member.

15. A wedge connector assembly in accordance with claim 14, wherein the spring member includes a leading edge, when the wedge member is mated in the first orientation, the leading end is substantially aligned with the leading edge, and when the wedge member is mated in the second orientation, the base wall of the notch is substantially aligned with the leading edge and the leading end is positioned forward of the leading edge.

16. A wedge connector assembly in accordance with claim 14, wherein the notch faces away from the inner surface when the wedge member is mated in the first orientation, and wherein the notch faces the inner surface when the wedge member is mated in the second orientation.

17. A wedge connector assembly in accordance with claim 14, wherein the notch further comprises side walls extending between the open face and the base wall, the side walls being spaced apart from the opposed sides of the wedge member.

18. A wedge connector assembly in accordance with claim 14, wherein the wedge member is configured to be mated with the spring member by an application tool, wherein the application tool engages the leading edge when the notch is in the first orientation, and wherein the application tool engages the base wall of the notch when the notch is in the second orientation.

19. A wedge connector assembly in accordance with claim 14, wherein the top engages the central section in the first orientation and the bottom engages the central section in the second orientation.

20. A wedge connector assembly comprising:

a spring member having a generally C-shaped body having an inner surface and an outer surface, the spring member having an opening therethrough; and a wedge member having a top, a bottom and opposed sides tapered between a leading end and a trailing end, the wedge member having a longitudinal axis extending between the leading and trailing end, the wedge member having a first barb extending from the top and a second barb extending from the bottom, the first and second barbs being longitudinally offset from one another;

wherein the first and second barbs are selectively received within the opening to define a mating position when the wedge member is mated with the spring member, and wherein the wedge member has at least two final mating positions.

21. A wedge connector assembly in accordance with claim 20, wherein the wedge member has a first orientation with respect to the spring member in a first mating position and the wedge member has a second orientation with respect to the spring member in a second mating position, and wherein the top and bottom are flipped with respect to one another in the first and second orientations.

22. A wedge connector assembly in accordance with claim 20, wherein the opening extends only partially through the spring member.

23. A wedge connector assembly in accordance with claim 20, wherein the spring member includes a web portion extending between the opening and a trailing edge of the spring member, the web portion being deflected by the barb during mating of the wedge member with the spring member.

24. A wedge connector assembly in accordance with claim 20, wherein the wedge member has a first orientation with respect to the spring member in a first mating position and the wedge member has a second orientation with respect to the spring member in a second mating position, and wherein the top faces the inner surface in the first orientation and the bottom faces the inner surface in the second orientation.

25. A wedge connector assembly in accordance with claim 20, wherein the wedge member is loadable into the spring member in a direction parallel to the longitudinal axis to a first mated position in which the first barb is received in a corresponding opening in the spring member and to a second mated position in which the second barb is received in a corresponding opening in the spring member.

26. A wedge connector assembly in accordance with claim 20, wherein the opening represents a first opening, the spring member further comprising a second opening longitudinally offset with respect to the first opening, the first barb being configured to be received in either the first opening or the second opening to define two different final mating positions of the wedge member.

* * * * *